US006698491B2

(12) United States Patent
Goldsmith et al.

(10) Patent No.: US 6,698,491 B2
(45) Date of Patent: Mar. 2, 2004

(54) MOVABLE WALL SYSTEM WITH INVERTED TROLLEY ASSEMBLY

(75) Inventors: Thomas L. Goldsmith, Earlville, IA (US); Jeff Kronlage, Dyersville, IA (US); Steve Helbing, Dubuque, IA (US)

(73) Assignee: Modernfold Inc., New Castle, IN (US)

( * ) Notice: Subject to any disclaimer, the term of this patent is extended or adjusted under 35 U.S.C. 154(b) by 39 days.

(21) Appl. No.: 10/043,243

(22) Filed: Jan. 31, 2002

(65) Prior Publication Data

US 2003/0141024 A1 Jul. 31, 2003

(51) Int. Cl.[7] ..... E05D 15/26
(52) U.S. Cl. ..... 160/199; 160/185
(58) Field of Search ..... 160/199, 196.1, 160/200, 206, 185; 52/243.1; 49/127; 16/65, 92, 101, 104

(56) References Cited

U.S. PATENT DOCUMENTS 3,783,930 A * 1/1974 Williams ..... 160/199
4,073,092 A * 2/1978 Williams ..... 49/127
4,159,556 A 7/1979 Dickson
4,401,033 A 8/1983 Gerken
4,569,164 A 2/1986 Dickson
4,642,947 A 2/1987 Dickson
4,752,987 A 6/1988 Dreyer et al.
4,837,891 A 6/1989 Toma et al.
5,016,318 A 5/1991 Harris
5,152,332 A 10/1992 Siener
5,499,671 A 3/1996 Owens
5,544,462 A 8/1996 Kordes
6,098,695 A 8/2000 Schwingle

* cited by examiner

*Primary Examiner*—Blair M. Johnson
(74) *Attorney, Agent, or Firm*—Baker & Daniels

(57) ABSTRACT

An inverted trolley assembly mounted in an upper channel of a movable wall panel. The inverted trolley includes an elongated trolley carrier having a centrally attached trolley block and a bore at each end to receive the axle of a roller assembly. Each roller assembly includes spacers to center the roller on the axles. The inverted trolley is connectable to a track mounted trolley, preferably by a threaded hole which receives a pendant bolt from the track mounted trolley. The inverted trolley is installed within a channel at the upper end of the wall panel with the rollers engaging the wall panel top frame thus supporting the wall panel. The panel top frame includes a slot through which connection to the track mounted trolley is made. The assembly also includes a trolley retainer which limits the range of motion of the inverted trolley.

27 Claims, 7 Drawing Sheets

MOVABLE WALL SYSTEM WITH INVERTED TROLLEY ASSEMBLY

BACKGROUND OF THE INVENTION

The present invention pertains to operable wall panels movable to partition large rooms into smaller rooms, and, in particular, to an inverted trolley assembly that eliminates binding of the wall panels when they are moved from a wall-forming position to a stacked position.

Operable walls or partitions, also known as movable wall panel systems, find useful application in a variety of venues, such as classrooms, offices, convention centers and hospitals. In these venues, the operable walls can be utilized to efficiently divide or compartmentalize an interior space into a multitude of separate, smaller rooms. Operable wall panels are typically connected to trolleys that roll within an overhead track. Travel of the trolleys within the track allows the panels to be moved between a stacked arrangement in a storage location, and a wall-forming, extended arrangement in alignment with the overhead track.

One type of movable wall panel system is a continuously-hinged system in which each operable partition is typically hinged to its adjacent partitions. Continuously-hinged wall panel systems are frequently electrically driven between their stacked and extended positions. When arranged in a proper center stacked position, the operable partitions are folded over one another accordion style with each panel or partition being oriented generally transverse to the overhead track.

One shortcoming of continuously-hinged operable partitions is that during partition movement, and usually before unfolding, stacked partitions have a tendency to move along the overhead track away from the location at which they are arranged when properly stacked. For instance, when continuously-hinged operable partitions are extended to form a wall, the leading partition, which is connected to an electric motor via a chain, is pulled from its transverse position at the end of a stacked set of partitions and begins to straighten out. Straightening of the leading partition is normally assisted by guide rails flanking the overhead track which engage the partitions. As the leading partition is pulled off, the remaining stacked partitions, still in a substantially stacked arrangement transverse to the track, often begin to move out in the wall extending direction. This movement is undesirable as these stacked partitions can jam at the guide rails and hinder further wall extension.

The movement of folded partitions may also be problematic when continuously-hinged operable partitions are stacked. During the stacking process, the trailing partitions which first reach the stacking area are manipulated to break and stack. If these stacked partitions move sideways, they may interfere with the stacking of subsequent partitions and frustrate the stacking process. These problems can be aggravated with non-level tracks as gravity may cause some partitions to drift sideways.

An existing assembly or apparatus directed to the problem of movement of stacked panels includes two cables, with loops at each end, and a high tension spring assembly interconnecting the cables. The assembly spring is installed in a recess within the top edge of one partition, and each of the cables is guided through mounted diverters and connected to an adjacent partition. This assembly has several shortcomings. For instance, the assembly is difficult to install, and must be carefully checked and tightened before installation. The separate custom designed components of the assembly are also relatively expensive. Furthermore, the design of the assembly requires that the cables pass within the space normally occupied by the top sweeps, i.e. the space which extends from the room ceiling. The removal of a portion of the top sweeps to accommodate the cables results in a degradation of the acoustical performance of the partition.

Another system developed to address this problem is disclosed in U.S. Pat. No. 5,499,671 which is assigned to the assignee of the present invention. This patent discloses an apparatus that includes first and second camming assemblies which are positioned along the track and cooperate with plates extending from the trolley to resist passage of a panel if the panel is transversely positioned relative to the track. The apparatus includes numerous components including pivots, bearings, rollers, and biasing springs, etc. and also requires adjustment of the components.

Neither of these approaches addresses the problem of binding of the panels during stacking and extending operations with panels suspended from rigidly centered trolleys. Binding can occur during stacking or unfolding where the panels lock up because adjacent panels, both with trolleys, do not have sufficient play at their leading or trailing edge to extend while pivoting on the trolley. This can be dealt with by removing a trolley from adjacent panel pairs; however, this results in the panel being supported solely by the hinge connections to its adjacent panels which adds unnecessary load to the hinge.

Thus, a need remains for an assembly that diminishes the tendency of stacked panels to resist unfolding by moving while remaining in a stacked arrangement and also prevents binding of the panels without the disadvantages of the aforementioned solutions.

SUMMARY OF THE INVENTION

The present invention provides an inverted trolley assembly for supporting a movable wall panel from within the panel and interconnecting the movable wall panel to a movable wall system. The inverted trolley includes a carrier having first and second ends with a roller assembly attached to each end. The rollers are positioned to engage the underside of the top frame of the movable wall panel when the inverted trolley is installed within the panel. In a preferred embodiment, spacers are included with the roller assembly to center each roller on its axle. The inverted trolley also includes a trolley block attached to the carrier that is connectable to the external trolley of the track and trolley system.

In another aspect of the invention, there is provided a movable wall panel with a movable trolley attachment in the form of an inverted trolley for connecting the movable wall panel to an external trolley. The wall panel has a top frame at its upper end. The top frame defines a channel and has a top portion that includes an opening in communication with the channel. In a preferred embodiment, the opening is an elongated slot. The inverted trolley assembly is disposed within the channel in the top frame and is movable within the channel. The trolley attachment assembly is accessible through the elongated slot in the wall panel top frame. In a preferred embodiment, the panel also includes a trolley retainer attached to the base of the channel in the wall panel top frame. The trolley retainer has upstanding portions that limit the range of movement of the trolley attachment assembly.

In yet another aspect of the invention, a movable wall system is provided including a track, a plurality of wall panels, each panel having a trolley attachment assembly in the form of an inverted trolley that is movable within a channel in the wall panel top frame, and a second trolley connecting the wall panel and inverted trolley combination to the track for movement of the wall panel along the track.

The invention provides a trolley system that eliminates binding of operable wall panels when folded on a single track centerline.

The invention further provides a trolley system that allows continuously hinged wall panels to have support trolleys on adjacent panels while operating without binding.

DESCRIPTION OF THE PREFERRED EMBODIMENTS

Figure 1:
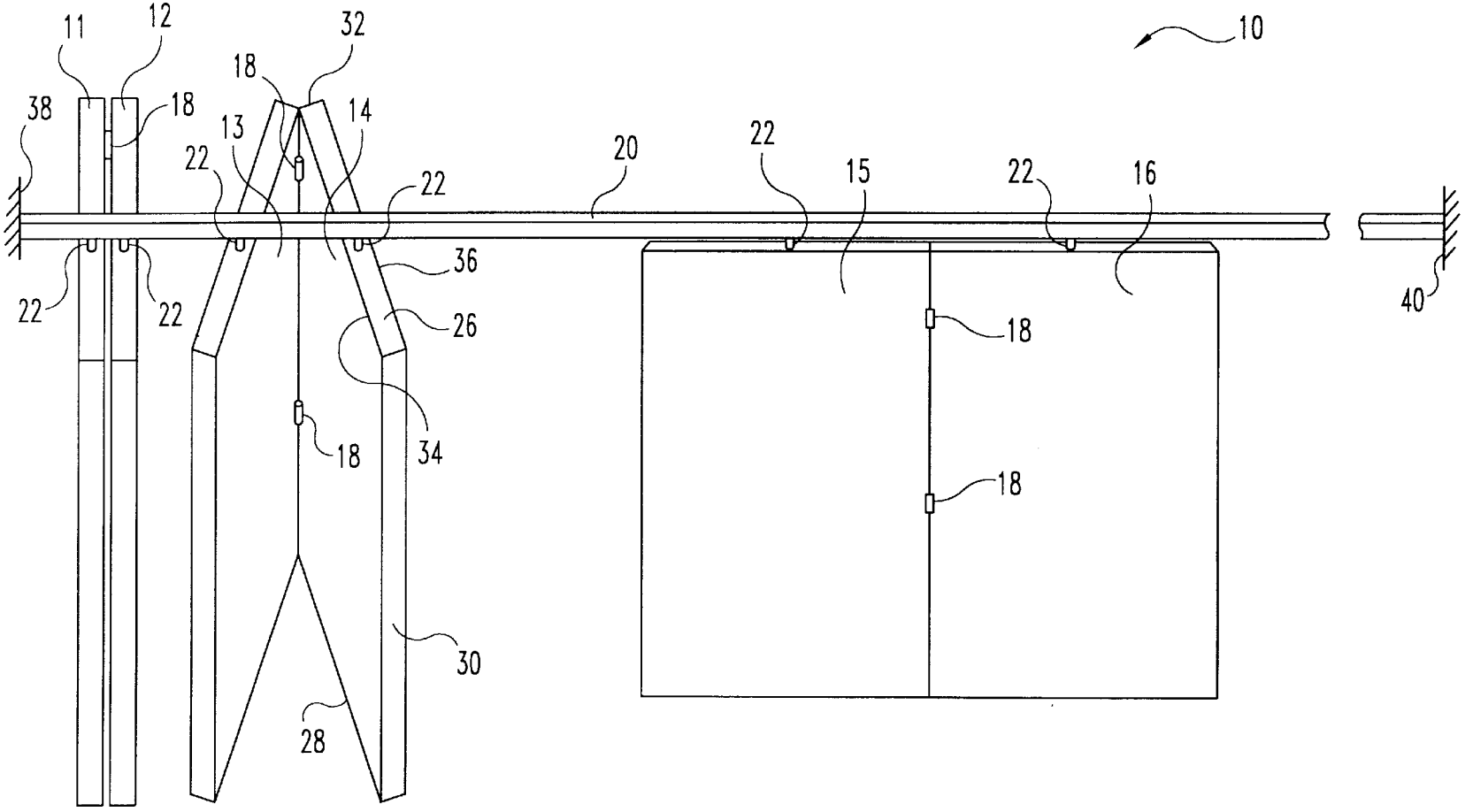
FIG. 1 is a diagrammatic perspective view of one embodiment of an operable wall shown being moved from a fully stacked arrangement to an extended wall-forming arrangement, for which the various embodiments of the inverted trolley assembly described herein may be employed.

For the purposes of promoting an understanding of the principles of the invention, reference will now be made to the embodiments illustrated in the drawings and specific language will be used to describe the same. It will nevertheless be understood that no limitation of the scope of the invention is thereby intended. The inventions includes any alterations and further modifications in the illustrated devices and described methods and further applications of the principles of the invention which would normally occur to one skilled in the art to which the invention relates.

Referring now to FIG. 1, there is diagrammatically shown an operable wall, generally designated 10, which may be equipped with any of the panel anti-stacking systems of the present invention. Operable wall 10 is shown as a paired panel system including three pairs of wall panels suspended from an abstractly shown track 20. The operable wall typically would include more panels than the shown three pairs, but only such panels are shown as are needed to facilitate illustration and explanation. Operable walls having fewer or even more panel pairs than shown may employ the present invention.

Wall panel 11 is linked to panel 12, panel 13 is linked to panel 14, and panel 15 is linked to panel 16, by multiple hinges 18 arranged along the panel height. Paired panels 11 and 12 are shown in a stacked or folded arrangement with the panel width oriented transverse to track 20. Panels 13 and 14 are shown in a partially unfolded arrangement assumed as the panels are pulled along track 20 from a stacked position toward a wall-forming position. Panels 15 and 16 are shown in an extended or unfolded arrangement as they are moved to a wall-forming location along the length of track 20. As referenced with respect to panel 14, each of panels 11–16 generally includes a top edge 26, a bottom edge 28, a vertical leading edge 30 and a vertical trailing edge 32, with leading and trailing used throughout the application in reference to the relative position of various components which occurs when the panels are being moved from a stacked position to an extended position. Also with reference to panel 14, each of the panels also includes side facades 34, 36 that are aligned to form exposed wall surfaces in the room areas separated by operable wall 10 when operable wall 10 is fully extended.

Figure 2:
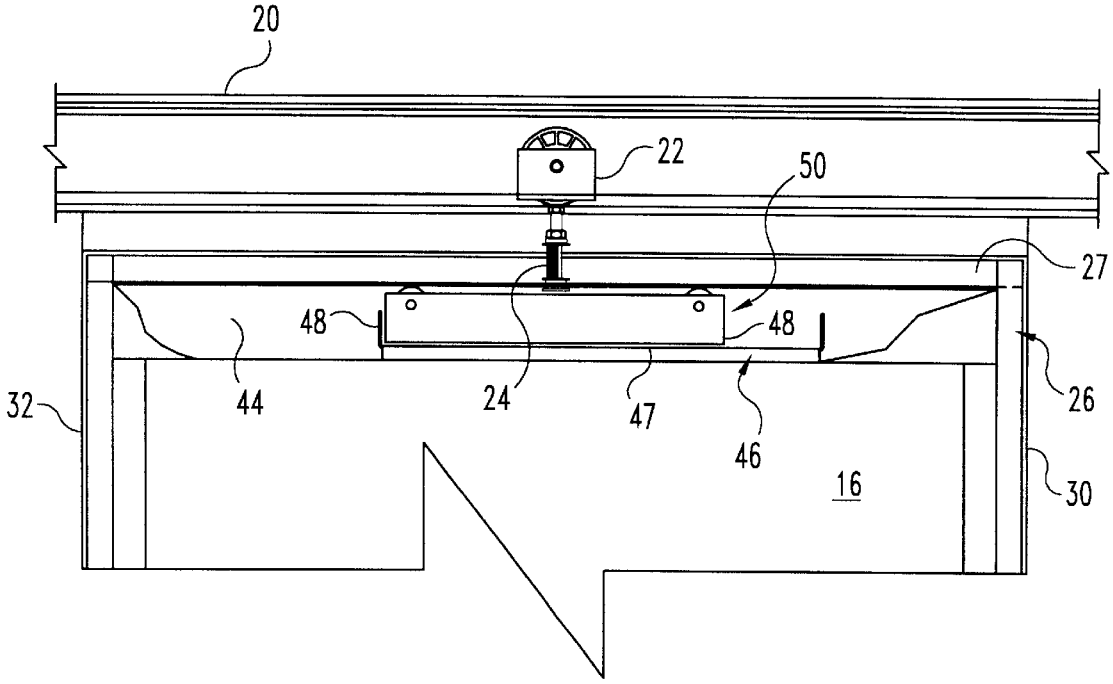
FIG. 2 is a front view of a wall panel cut away to show an inverted trolley assembly according to the present invention.

Each of panels 11–16 is suspended from track 20 by trolley 22 abstractly represented in FIG. 1 and shown in more detail in FIG. 2. The term trolley is used generally herein and is intended to encompass devices of all types that are operably connected to and movable along the track, including wheeled carriages and carriers. The term inverted trolley as used herein is a reference to the subject of the present invention and is used interchangeably with the term trolley attachment assembly which refers to an assembly interconnecting a wall panel to a traditional trolley of a movable wall system that allows relative motion between the wall panel and the traditional trolley.

Track 20 spans fixed walls 38 and 40 and is mounted to a support structure (not shown) above the room to be compartmentalized in a well-known fashion. The track parts along which the trolleys 22 ride are located above the ceiling of the room (not shown in FIG. 1). Panels 11–16 may be moved along the track in any known fashion in wall-stacking and wall-extending directions.

Although shown as being employed with a paired panel system, the inverted trolley systems described herein may be adapted for use with different panel systems, including continuously hinged systems and even single panel systems having a single trolley per panel, and with different or non-straight track layouts.

FIG. 2 shows a wall panel 16 suspended from the track 20 by trolley 22 and inverted trolley assembly 50 installed within panel 16. In adapting wall panel 16 for use with inverted trolley assembly 50, wall panel 16 can include a top frame 26 that can be provided with a channel 44. The inverted trolley assembly 50 is housed within the top frame channel 44. Trolley retainer 46 is preferably mounted flush with the bottom of the top frame channel 44, preferably by welding. The trolley retainer 46 preferably has a base portion 47 and upstanding portions 48 within which the inverted trolley assembly 50 is positioned.

Figure 3:
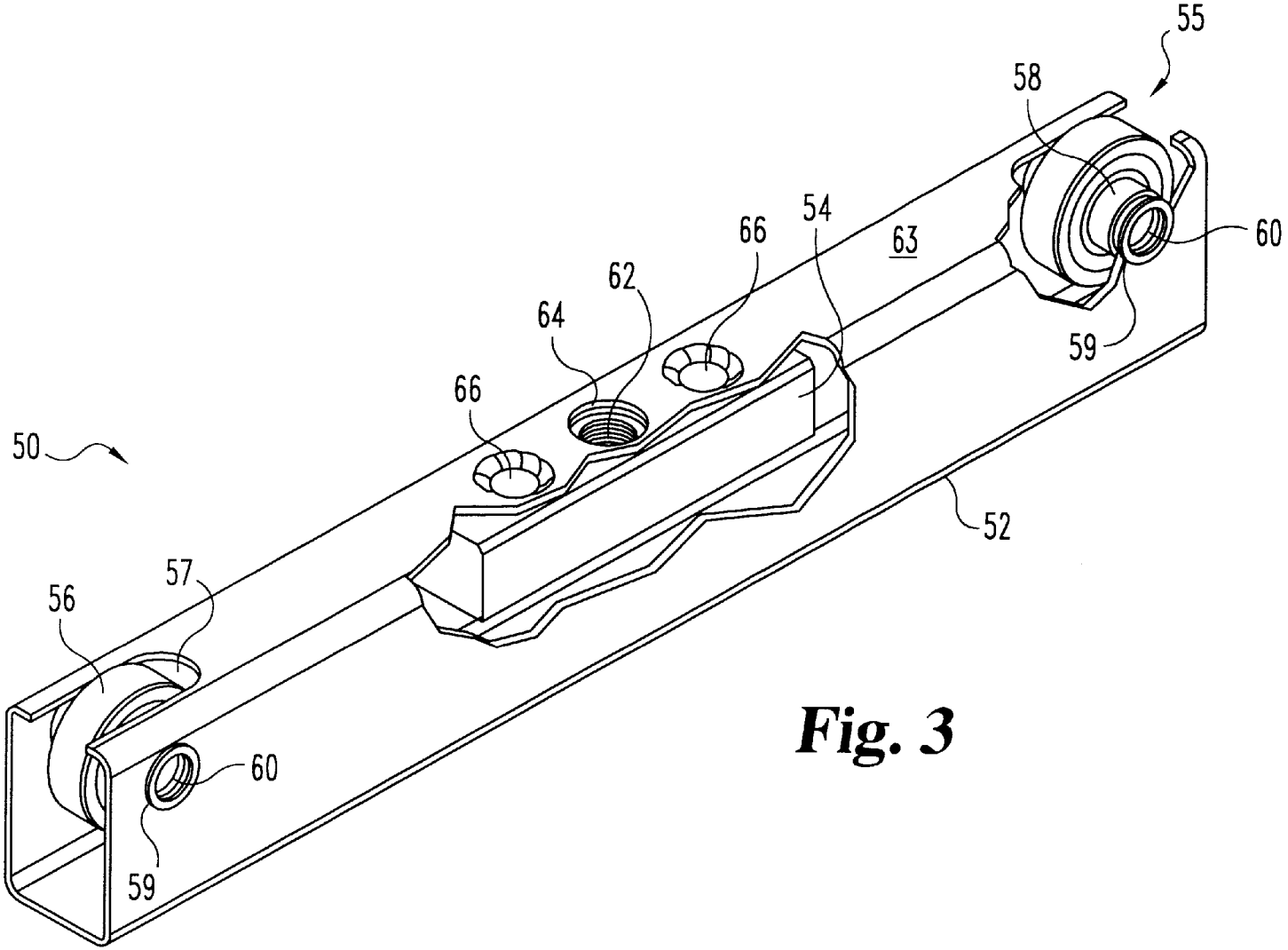
FIG. 3 is a perspective view of an inverted trolley according to one embodiment of the present invention.

Inverted trolley 50 is shown in detail in FIG. 3. In a preferred embodiment, the inverted trolley assembly includes a carrier 52 that is preferably formed as a channel with a rectangular cross section. The carrier 52 includes a bearing assembly at each end to facilitate movement of the inverted trolley within the top frame channel 44. In a preferred embodiment, the bearing assembly can be a roller assembly 55. A bore 59 is provided at each end of carrier 52 through which axles 60 can be received. A roller 56 is mounted on each axle 60. Spacers 58 can be included to help center the rollers 56 on axles 60. In one embodiment of the invention, portions of rollers 56 extend through a slot 57 in the carrier 52 so that the rollers 56 can engage the underside of the top portion of the top frame 26 in the manner shown in FIG. 2.

With reference still to FIG. 3, a trolley block 54 is attached to the carrier 52. In a preferred embodiment, the trolley block is inside the channel of carrier 52. The trolley block 54 is provided with an attachment portion 62 for connecting the trolley block 54 to the track mounted trolley 22. Preferably, this attachment is a threaded hole 62 which is sized to receive a pendant bolt 24 as shown in FIG. 2. The threaded hole 62 in trolley block 54 is coaxially aligned with an access hole 64 in the upper side 63 of the carrier 52. The carrier upper side 63 can also include holes 66 for mounting the trolley block 54 to the carrier 52. In a preferred embodiment, the trolley block 54 can be plug welded in place at holes 66. Alternatively, the trolley block 54 can be drilled, tapped, and held by bolts or screws at hole 66.

Figure 4A:
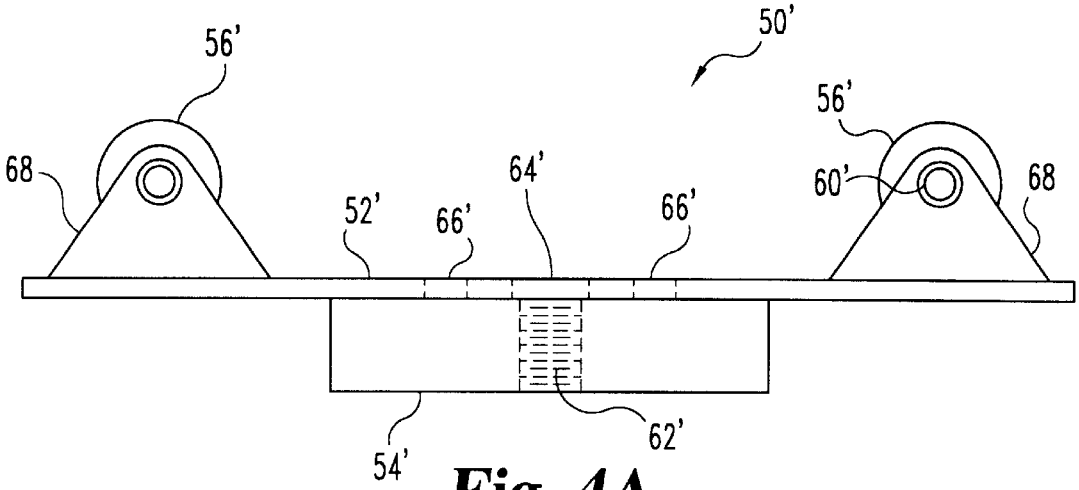
FIG. 4A is a front elevational view of another embodiment of an inverted trolley according to the present invention.

An alternative embodiment of an inverted trolley 50' is shown in FIG. 4A. In this embodiment, the trolley carrier 52' is a flat plate with roller mounting tabs 68 at each end. The tabs include bores for axles 60' on which rollers 56' are mounted. Although shown in FIG. 4A as attached to the underside of carrier 52', a trolley block 54' could also be mounted on the top surface of carrier 52'. As depicted in FIG. 4A, attachment of the trolley block 54' to carrier 52' can be by welding or by fasteners through holes 66'. Access is provided through hole 64' in carrier 52' for a pendant bolt for attachment to a track mounted trolley.

Figure 4B:
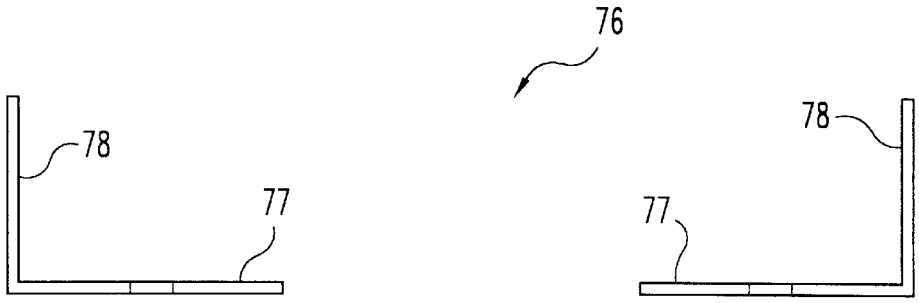
FIG. 4B is a front elevational view of an alternate embodiment of a retainer in accordance with the present invention.

An alternative embodiment of a trolley retainer 76 is shown in FIG. 4B. In this embodiment, the trolley retainer 76 can include a pair of stops, each preferably having a base portion 77 and upstanding portion 78. The stops can be attached to either the bottom of the top frame channel 44 or to the underside of the top portion of the top frame 26 preferably by welding. Alternatively, attachment may be accomplished using bolts or screws.

Figure 4C:
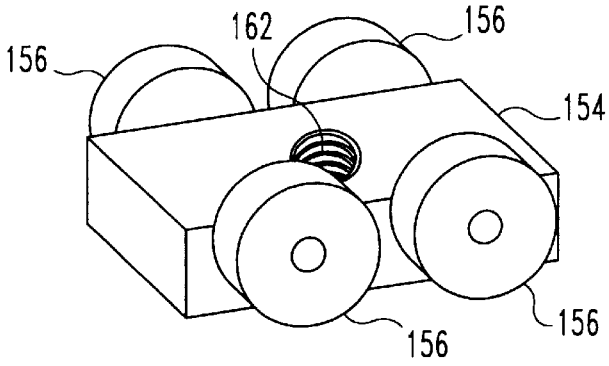
FIGS. 4C and 4D are top perspective views of alternate embodiments of an inverted trolley in accordance with the present invention.
Figure 4D:
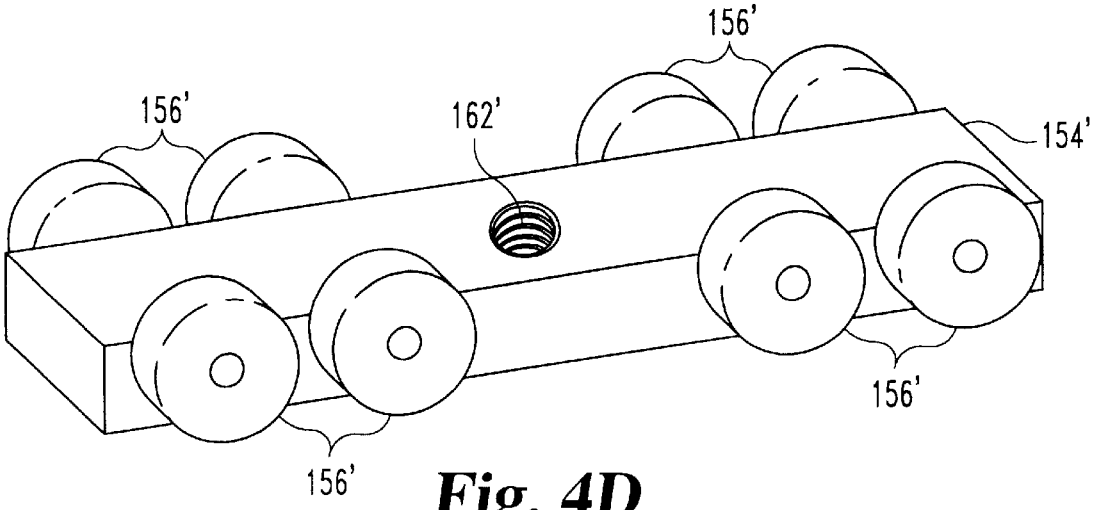

Other variations of an inverted trolley are shown if FIGS. 4C and 4D. These variations are similar to a traditional trolley with body portions 154 and 154' adapted for pendant bolt attachment to a track mounted trolley at holes 162 and 162'. Wheels 156 and 156' can be mounted on the body portions by any conventional means. Preferably at least four wheels would be used with the inverted trolleys of FIGS. 4C and 4D for stability of the wall panel on the inverted trolleys; however as few as two wheels may be used.

Figure 5:
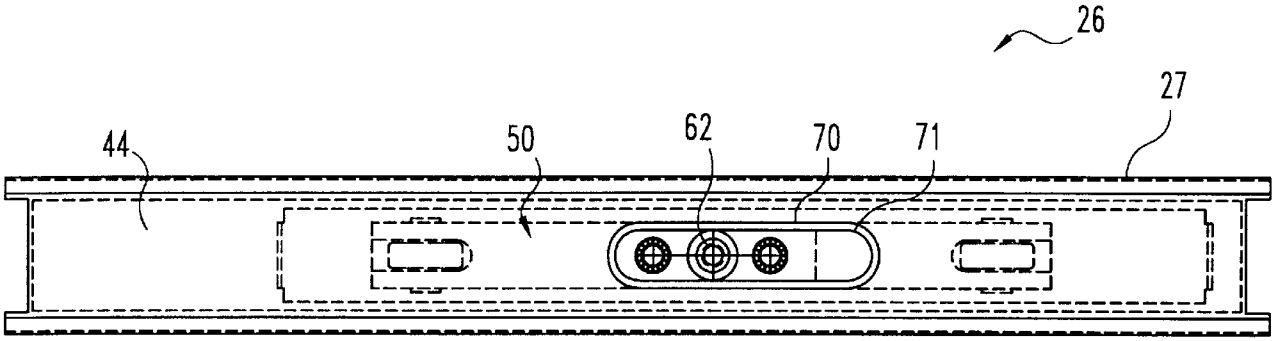
FIG. 5 is a top view of a removable wall panel for use with an inverted trolley according to the present invention.

Turning now to FIG. 5, a detailed view of the wall panel top frame 26 is shown. Top frame cap 27 includes an opening 70, within which is centered over a similar opening 71 in the upper side of top frame 26 that provides an access to the top frame channel 44 at the upper end of the wall panel. In a preferred embodiment, openings 70 and 71 can be in the form of elongated slots. Inverted trolley 50 is shown in ghost outline in FIG. 5. Slot 70 provides access to the inverted trolley 50 and specifically to the threaded hole 62 for attachment of the track mounted trolley to the trolley block, which is hidden in this view.

Figure 6:
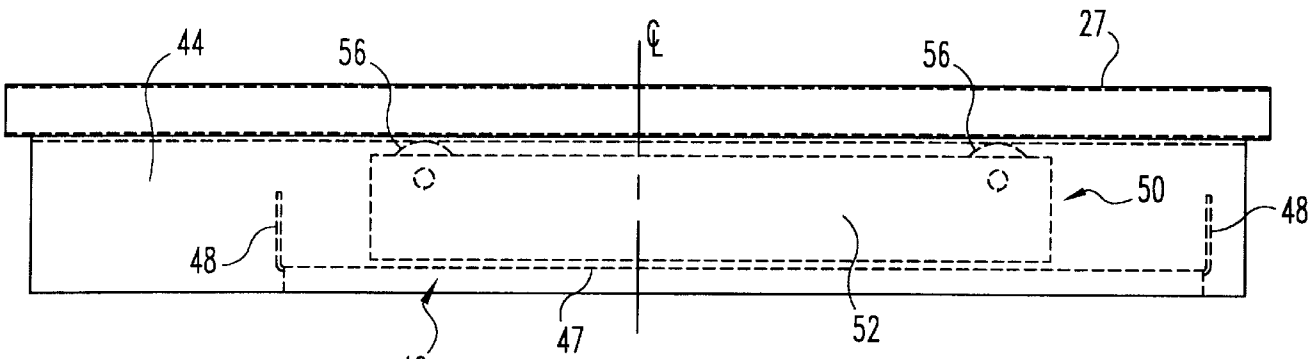
FIG. 6 is a front elevational view of a wall panel having an inverted trolley of the present invention shown in ghost outline.

As shown in FIG. 6, with the inverted trolley assembly 50 in place within the wall panel top frame channel, the rollers 56 engage the underside of the top frame channel 26. Thus, the inverted trolley assembly 50 supports the wall panel from the underside of top frame 26. Trolley retainer 46 is also shown in ghost outline in FIG. 6. The range of movement of the inverted trolley assembly 50 can be limited by the span between the upstanding portions 48 of the retainer 46, or alternatively by the length of slot 71. Preferably, the length of slots 70 and 71 are sized so that the full range of travel afforded by the trolley retainer 46 is maintained. Alternatively, slots 70 and/or 71 can be used to limit the movement of trolley assembly 50, in which case, the trolley retainer 46 is used to locate the inverted trolley assembly 50 to attach the pendent bolt 24.

With the inverted trolley installed, the wall panel 16 is also movable relative to the track-mounted trolley 22. In a preferred embodiment, the relative length of the trolley carrier 52 and the trolley retainer 46 determines the range of motion of the wall panel relative to track trolley 22 which corresponds to the range of movement of the inverted trolley 50 within the wall panel 16. In a preferred embodiment, the trolley carrier 52 can be about 13 inches in length with a trolley retainer 46 of about 17.5 inches in length and yielding a range of motion of about 4.5 inches.

Figure 7:
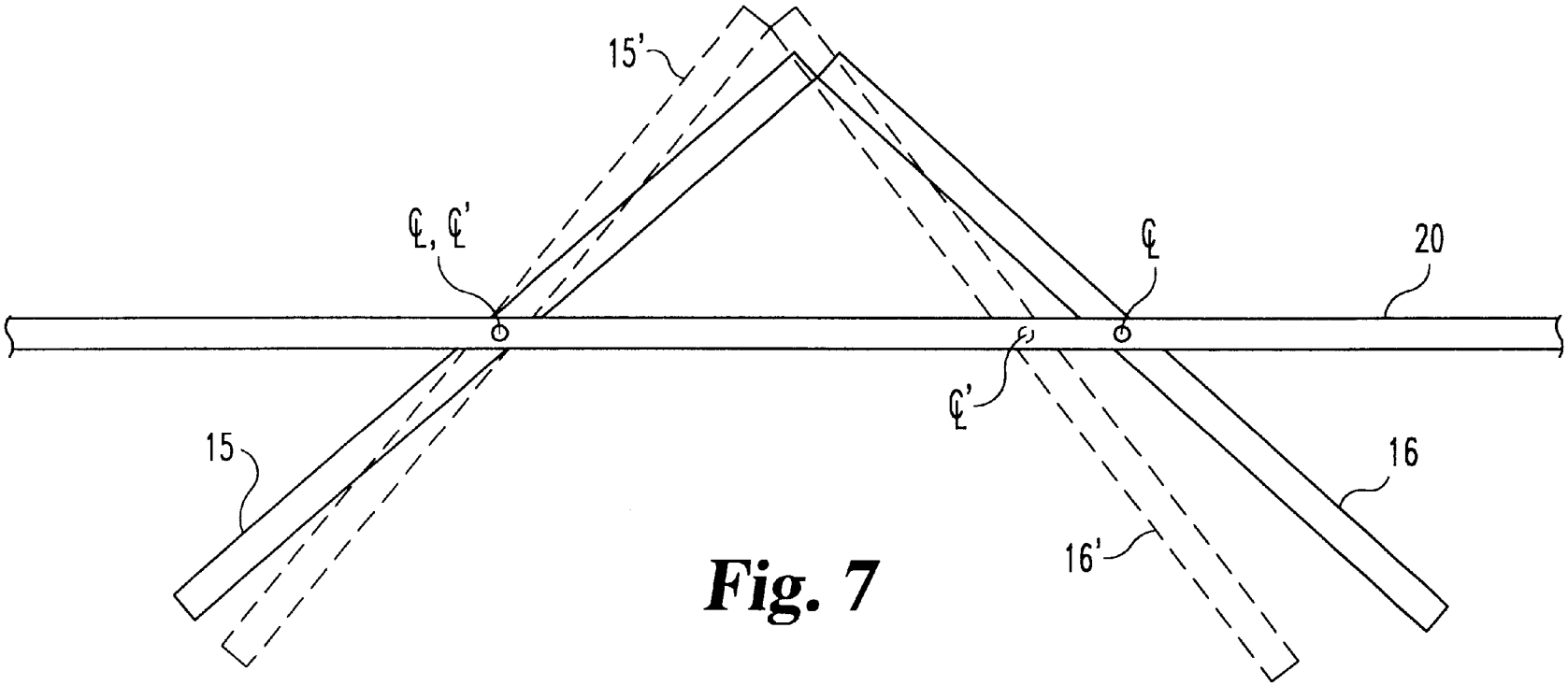
FIG. 7 is an overhead view of a pair of hinged wall panels demonstrating the operation of the inverted trolley system of the present invention.

The trolley retainer 46 as well as slots 71 and 70 are preferably offset with respect to the panel centerline toward the panel leading edge. In a preferred embodiment, this offset is about 1.75 inches. This placement of the assembly assists in eliminating the tendency of the panels to bind. The wall panel 16 is thus allowed to float rather than being rigidly attached to the track mounted trolley 22. The floating action eliminates the binding that often occurs when adjacent panels with rigid center trolley connections are folded on a single track center line. This avoidance of binding is made possible by the panel's ability to move with respect to the track mounted trolley which provides the panel with limited capability to pivot about the hinged connection while stationary. This action is demonstrated in FIG. 7. Viewed from above, track 20 is shown with hinged panels 15 and 16 in solid outline and partially folded and with the track mounted trolley at the centerlines of both panels. The panels are shown being further folded in ghost outline as panels 15' and 16' where panel 16' is displaced relative to the track mounted trolley. Panel 15' has pivoted while remaining at the same track location while panel 16' has move closer to panel 15'. It is this movement relative to the track mounted trolley that prevents binding of the panels. With the concern for binding alleviated, there is provided the added benefit of allowing continuously hinged panels to have support trolleys in each adjacent panel.

The inverted trolley components are preferably of steel construction; however, other materials capable of supporting the weight of the wall panel may be used.

Although the invention has been described in terms of a carrier having two wheels, it should be noted that other configurations are also possible. For instance, the inverted trolley could be fitted with four or more wheels. Alternatively, the inverted trolley could be fitted with sliders instead of wheels.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

What is claimed is:

1. A movable wall system comprising:

a track;

a wall panel guide member movable along said track; and an assembly supporting a movable wall panel and interconnecting said panel to said guide member and effectuating a pivotal motion of said movable wall relative to said track about a vertical axis said assembly comprising:

a carrier connectable to the guide member and having first and second opposite ends said carrier extending across a centerline of said wall panel; and a first bearing assembly attached to said first end of said carrier and a second bearing assembly attached at said second end of said carrier, said first and second bearing assemblies having a surface configured for movable engagement with the underside of a frame of the wall panel, in which the weight of the movable wall panel is supported by said carrier while said carrier moves relative to the wall panel and said carrier structured and arranged to keep each of said first and second opposite ends on each side of the centerline of said wall panel.

2. The movable wall system of claim 1 further including a retainer coupled to the wall panel and configured to limit the movement of said carrier relative to the wall panel, said retainer extending substantially across the centerline of said wall panel.

3. The movable wall system of claim 1 further comprising a block member attached to said carrier, said block member defining a threaded hole sized to receive a pendant bolt for connecting said carrier to the guide member.

4. The movable wall system of claim 1 wherein each said first and second bearing assemblies includes a roller assembly.

5. The movable wall system of claim 2 wherein said retainer includes a pair of stops, each having an upstanding portion configured to limit the movement of said carrier relative to the wall panel.

6. A movable wall panel comprising:

a wall panel having a width, a vertical centerline, and a leading edge, and a first portion defining a channel therein, said first portion including a surface facing said channel, and an edge portion defining an opening therein in communication with said channel; and a trolley attachment assembly disposed within said channel and moveable relative to said and in fore and aft directions along said panel width and having a length which extends across said vertical centerline in any position within said channel, said trolley attachment assembly being accessible through said opening of said edge portion to pivotally attach said wall panel to a trolley of a movable wall system, and said trolley attachment assembly supporting the weight of said panel and effectuating pivotal movement of said wall panel about a vertical axis.

7. The movable wall panel of claim 6, wherein said opening is offset from said centerline toward said leading edge.

8. The movable wall panel of claim 6, wherein said trolley attachment assembly includes:

a carrier having first and second opposite ends; and a first bearing assembly attached to said first end of said carrier and a second bearing assembly attached at said second end of said carrier, said first and second bearing assemblies arranged for movable engagement with said channel facing surface, said first bearing assembly staying on one side of said vertical centerline and said second bearing assembly staying on another side of said vertical centerline.

9. The movable wall panel of claim 8, wherein said trolley attachment assembly further includes a trolley block attached to said carrier and defining a hole sized to receive a pendant bolt for connection to the trolley of the movable wall system through said opening.

10. The movable wall panel of claim 9 further including a pendant bolt for connecting said trolley block to the trolley.

11. The movable wall panel of claim 8 wherein each said first and second bearing assemblies includes a roller assembly.

12. The movable wall panel of claim 8 further including a retainer disposed within said channel and attached to said panel, said retainer configured to limit movement of said trolley attachment assembly in said fore and aft directions.

13. The movable wall panel of claim 12 wherein said retainer includes a central portion between first and second opposite upstanding portions.

14. The movable wall panel of claim 12 wherein said retainer includes a pair of stops, each having an upstanding portion configured to limit the movement of said carrier relative to the wall panel.

15. The movable wall panel of claim 12 wherein said retainer is offset from said centerline toward said leading edge of said wall panel.

16. The movable wall panel of claim 12 wherein said carrier has a length and said retainer has a length between said upstanding portions which is greater than said length of said carrier.

17. A movable wall system comprising:

a track;

a plurality of wall panels, each said wall panel having a width, a vertical centerline, and a leading edge and including a trolley attachment assembly movably engaged therewith for movement relative to said panel in fore and aft directions along said width; and a trolley connected to said trolley attachment assembly and movable along said track for movement of said wall panel, said trolley attachment assembly extending across said vertical centerline regardless of the fore and aft directions said wall panel pivotable relative to said track about a vertical axis.

18. The movable wall system of claim 17 wherein each of said plurality of wall panels further includes a first portion defining a channel therein, said first portion including a surface facing said channel, and an edge portion defining an opening therein in communication with said channel.

19. The movable wall system of claim 18 wherein said opening in each of said plurality of wall panels is offset from said centerline toward said leading edge.

20. The movable wall system of claim 18 wherein said trolley attachment assembly is disposed within said channel.

21. The movable wall system of claim 17 wherein said trolley attachment assembly includes:

a carrier having first and second opposite ends extending across said vertical centerline of each wall panel;

a first bearing assembly attached to said first end of said carrier and a second bearing assembly attached at said second end of said carrier, said first and second bearing assemblies arranged for movable engagement with a surface of said wall panel; and a trolley block attached to said carrier and connectable to the movable wall system through an opening in an edge portion.

22. The movable wall system of claim 21 wherein each said first and second bearing assemblies includes a roller assembly.

23. The movable wall system of claim 21 further including a retainer coupled to said wall panel and configured to limit movement of said trolley attachment assembly in said fore and aft directions.

24. The movable wall system of claim 23 wherein said retainer includes a central portion between first and second opposite upstanding portions.

25. The movable wall system of claim 23 wherein said retainer includes a pair of stops, each having an upstanding portion configured to limit the movement of said carrier relative to the wall panel.

26. The movable wall system of claim 23 wherein said retainer is offset from said centerline toward said panel leading edge.

27. The movable wall system of claim 23 wherein said carrier has a length and said retainer has a length between said upstanding portions which is greater than said length of said carrier.

* * * * *

UNITED STATES PATENT AND TRADEMARK OFFICE

CERTIFICATE OF CORRECTION

PATENT NO. : 6,698,491 B2
DATED : March 2, 2004
INVENTOR(S) : Goldsmith et al.

It is certified that error appears in the above-identified patent and that said Letters Patent is hereby corrected as shown below:

Column 8,
Line 11, after the words “relative to said” insert -- panel -- and after the inserted word delete “and”

Signed and Sealed this

Eighteenth Day of May, 2004

JON W. DUDAS
*Acting Director of the United States Patent and Trademark Office*